US010731405B2

(12) United States Patent
Hall

(10) Patent No.: US 10,731,405 B2
(45) Date of Patent: Aug. 4, 2020

(54) SHOWER DOOR

(71) Applicant: KINGSWAY ENTERPRISES (UK) LIMITED, Swanley, Kent (GB)

(72) Inventor: Benjamin Hall, Swanley (GB)

(73) Assignee: Kingsway Enterprises (UK) Limited, Kent (GB)

( * ) Notice: Subject to any disclaimer, the term of this patent is extended or adjusted under 35 U.S.C. 154(b) by 189 days.

(21) Appl. No.: 15/977,325

(22) Filed: May 11, 2018

(65) Prior Publication Data

US 2018/0325326 A1 Nov. 15, 2018

(30) Foreign Application Priority Data

May 15, 2017 (GB) ..... 1707744.7
May 9, 2018 (GB) ..... 1807567.1

(51) Int. Cl.

| | |
|---|---|
| ***E06B 7/23*** | (2006.01) |
| ***A47K 3/30*** | (2006.01) |
| ***E05C 19/16*** | (2006.01) |
| ***E05D 11/06*** | (2006.01) |
| ***E06B 7/22*** | (2006.01) |
| ***E06B 3/88*** | (2006.01) |
| ***E06B 7/36*** | (2006.01) |

(52) U.S. Cl.

CPC ..... *E06B 7/2309* (2013.01); *A47K 3/30* (2013.01); *E05C 19/161* (2013.01); *E05D 11/06* (2013.01); *E06B 3/88* (2013.01); *E06B 7/22* (2013.01); *E06B 7/2303* (2013.01); *E06B 7/36* (2013.01); *A47K 2003/305* (2013.01); *E05Y 2800/12* (2013.01); *E05Y 2900/114* (2013.01)

(58) Field of Classification Search

CPC ..... E06B 5/103; E06B 3/88; E06B 7/2309; E06B 7/36; E06B 7/2303
USPC ..... 16/374, 82, 86 A, 86 R, 86 B
See application file for complete search history.

(56) References Cited

U.S. PATENT DOCUMENTS

| | | | | |
|---|---|---|---|---|
| 3,141,204 A * | 7/1964 | Wheeler | ..... | E06B 3/02 49/383 |
| 4,658,544 A * | 4/1987 | McCarty | ..... | E05F 1/068 16/240 |
| 4,738,002 A * | 4/1988 | Shank | ..... | E05D 11/06 16/223 |
| 4,858,273 A * | 8/1989 | Civitelli | ..... | E05D 11/06 16/86 A |
| 5,023,965 A | 6/1991 | Reichel | | |
| 5,480,199 A | 1/1996 | Husting | | |

(Continued)

FOREIGN PATENT DOCUMENTS

| | | | | |
|---|---|---|---|---|
| CH | 398365 A * | 3/1966 | ..... | E05D 3/022 |
| DE | 102009009708 A1 * | 7/2010 | ..... | E06B 7/2309 |

(Continued)

OTHER PUBLICATIONS

Great Britain Patent Application 1707744.7 Search Report dated Jan. 25, 2018, 5 pages.

(Continued)

*Primary Examiner* — Marcus Menezes
(74) *Attorney, Agent, or Firm* — Erise IP, P.A.

(57) ABSTRACT

An apparatus for providing a seal between a door jamb and a hinged door leaf of a shower, the apparatus having a flexible body configured to be attached to the door jamb and configured to contact the door leaf when the door leaf is in a closed position.

8 Claims, 6 Drawing Sheets

(56) References Cited

U.S. PATENT DOCUMENTS 5,544,456 A * 8/1996 Dries ..... E06B 1/20 49/383
5,581,946 A * 12/1996 Lin ..... E05C 19/001 49/368
6,112,469 A * 9/2000 Vuillemot ..... E06B 7/2303 49/475.1
6,125,591 A * 10/2000 Schmidhuber ..... E06B 7/2318 49/477.1
7,559,114 B2 * 7/2009 Ranilovich ..... E05C 17/025 16/374
7,904,992 B2 * 3/2011 Agster ..... E05C 17/025 16/374
7,987,635 B2 * 8/2011 Thielke ..... E04H 1/1266 49/382
8,327,505 B2 * 12/2012 Smith ..... E05D 3/02 16/374
8,627,610 B1 * 1/2014 Crowther ..... E04H 1/1266 16/250
9,234,386 B2 * 1/2016 Dries ..... E06B 7/22
2005/0198910 A1 * 9/2005 Keller ..... E06B 3/70 49/501
2006/0032017 A1 * 2/2006 Agster ..... E05C 17/025 16/86 R

FOREIGN PATENT DOCUMENTS

| | | | | |
|---|---|---|---|---|
| EP | 0682905 | A1 | 11/1995 | |
| EP | 2615237 | A2 | 7/2013 | |
| GB | 1127308 | A * | 9/1968 | ..... F25D 23/087 |
| GB | 2136485 | A | 9/1984 | |
| GB | 2289302 | A | 11/1995 | |
| GB | 2408769 | A | 6/2005 | |
| GB | 2509326 | A | 7/2014 | |
| GB | 2516093 | A | 1/2015 | |
| GB | 2524237 | A | 9/2015 | |
| WO | WO-9412753 | A1 * | 6/1994 | ..... A47B 95/043 |
| WO | 2005089170 | A2 | 9/2005 | |

OTHER PUBLICATIONS

Great Britain Patent Application No. GB1807567.1, Combined Search and Examination Report dated Oct. 31, 2018.
CA Related Application No. 3,004,968 Examiner's Report dated Nov. 18, 2019.

* cited by examiner

SHOWER DOOR

RELATED APPLICATION

This application claims priority, with respect to all common subject matter, to Great Britain Patent Application No. 1707744.7, filed May 15, 2017, and Great Britain Patent Application No. 1807567.1, filed May 9, 2018, the disclosures of which are incorporated herein by reference in their entirety.

FIELD

The present disclosure relates to sealing mechanisms for doors used in healthcare applications. In particular, it relates to sealing apparatuses for shower doors where an anti-ligature function is required, for example in a psychiatric ward.

BACKGROUND

To ensure the safety of patients in healthcare environments, for example psychiatric wards, doorways need to provide a number of different functions. For example, a door set, which is comprised of a door leaf, a door frame and often a hinge to connect the two, should reduce, or prevent entirely, the possibility of a patient attaching a ligature with which they could harm themselves. This applies to all door sets in such an environment, including shower doors, which should also perform their usual functions of providing privacy and preventing water from exiting a shower cubicle into the bathroom.

SUMMARY

In accordance with an aspect of the disclosure there is provided an apparatus for providing a seal between a door jamb and a hinged door leaf of a shower, the apparatus comprising a flexible body configured to be attached to the door jamb and configured to contact the door leaf when the door leaf is in a closed position, wherein the flexible body is elongate and is hollow in cross-section perpendicular to its longest dimension.

The flexible body may be configured to extend the length of the door jamb. The flexible body may be configured to receive a stiffening element at one end. The apparatus may further comprise a first magnet inserted in the flexible body, the first magnet configured to interact with a second magnet comprised in the door leaf, wherein the first magnet and the second magnet are configured to attract the door leaf towards the closed position. The apparatus may further comprise a fixing element configured to extend the length of the flexible body and to attach the flexible body to the doorjamb.

In accordance with another aspect of the disclosure there is provided an apparatus for providing a seal between a door jamb and a hinged door leaf of a shower, the apparatus comprising a flexible body configured to be attached to the door leaf and configured to contact the door jamb to provide a seal when the door leaf is in a closed position, wherein the flexible body is elongate and is hollow in cross-section perpendicular to its longest dimension.

The flexible body may be configured to extend the length of the door leaf. The apparatus may further comprise a first magnet inserted in the flexible body, the first magnet configured to interact with a second magnet comprised in the door jamb, wherein the first magnet and the second magnet are configured to attract the door leaf towards the closed position. The apparatus may further comprise a fixing element configured to extend the length of the flexible body and to attach the flexible body to the door leaf.

The flexible body may be resilient such that it is configured to return to its original shape after deformation.

In accordance with another aspect of the disclosure there is provided a shower door set comprising a door frame comprising a first jamb and a second jamb parallel to the first jamb, a door leaf, a hinge to join the door leaf to the first or second jamb, and the apparatus.

The hinge may be configured to allow the door leaf to open in two directions from the closed position. The door frame may further comprise a third jamb that connects the first jamb to the second jamb, the third jamb comprising hinge cap comprising at least one stop configured to limit the opening of the door leaf in one direction to a specified angle. The door leaf may comprise a top surface that slopes downward from the hinge side of the door leaf to a seal side of the door leaf distal the hinge side.

The door leaf may comprise a rounded corner between its top surface and a surface of the door leaf on the seal side of the door leaf.

The top surface of the door leaf may comprise a continuously curved profile from the hinge side of the door leaf to the seal side of the door leaf. The continuously curved profile may include a rounded corner at the seal side of the door leaf. The continuously curved profile may include a concave portion between the rounded corner and the hinge side of the door leaf.

Door leaf may also include a rounded bottom corner at the seal side of the door leaf.

Also disclosed is an apparatus for providing a seal between a door jamb and door leaf of a shower, the apparatus comprising a flexible body comprising a first portion configured to be attached to the door jamb and a second portion configured to be distal to the door jamb when the flexible body is attached to the door jamb, wherein the second portion is configured to contact the door leaf when the door leaf is in a closed position.

Also disclosed is an apparatus for providing a seal between a door jamb and door leaf of a shower, the apparatus comprising a flexible body comprising a first portion configured to be attached to the door leaf and a second portion configured to be distal to the door leaf when the flexible body is attached to the door leaf, wherein the second portion is configured to contact the door jamb when the door leaf is in a closed position.

Also disclosed is an apparatus for providing a seal between a door jamb and door leaf of a shower, the apparatus comprising a flexible body comprising a first portion configured to be attached to the door jamb or the door leaf and a second portion configured to be distal to the door jamb or door leaf when the flexible body is attached to the door jamb or door leaf, wherein the second portion is configured to contact the door leaf or the door jamb when the door leaf is in a closed position.

Also disclosed is an apparatus for providing a seal between a door jamb and door leaf of a shower, the apparatus comprising a flexible body configured to be attached to the door jamb or the door leaf and configured to contact the door leaf or the door jamb to provide a seal when the door leaf is in a closed position.

BRIEF DESCRIPTION OF THE DRAWINGS

Exemplary embodiments of the disclosure shall now be described with reference to the drawings in which.

Throughout the description and the drawings, like reference numerals refer to like parts.

SPECIFIC DESCRIPTION

Figure 1:
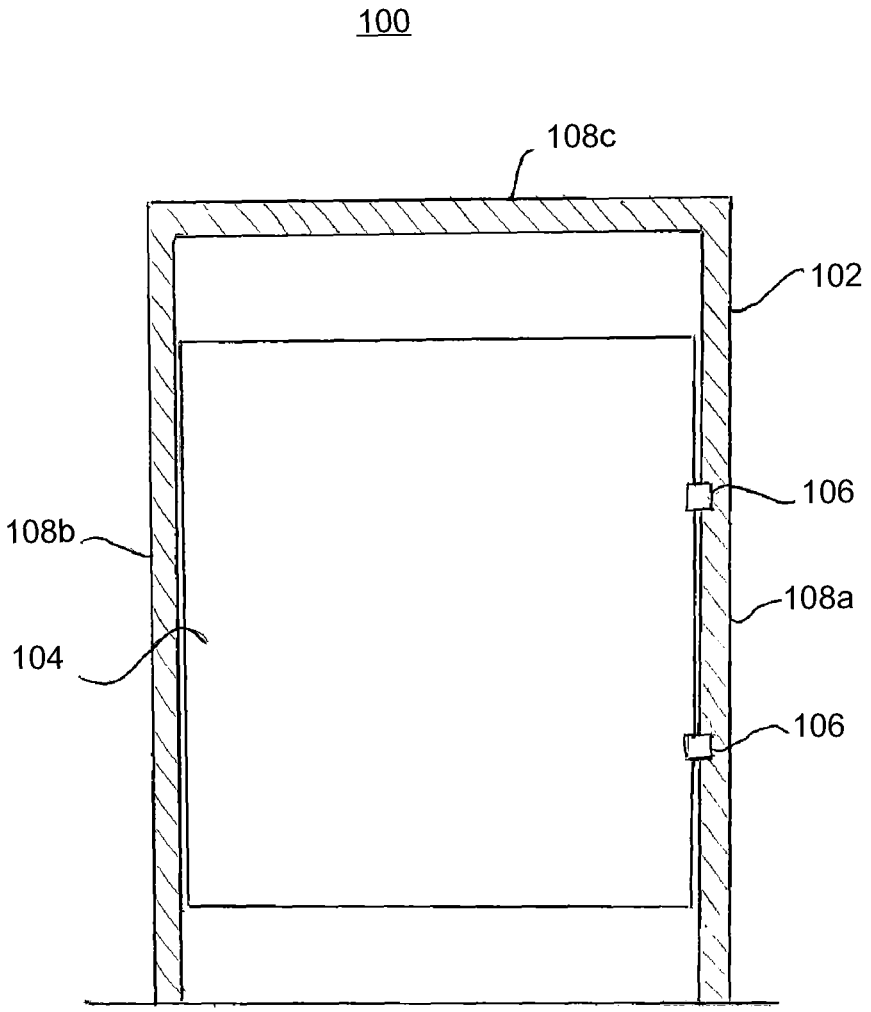
FIG. 1 Prior Art
FIG. 1 shows a schematic view of a shower door known in the art.

FIG. 1 shows an example of a shower door 100 known in the art. The shower door comprises a door frame 102, a door leaf 104 and hinges 106. The door frame comprises a hinge jamb 108*a*, a seal jamb 108*b* and a header 108*c*. With this conventional shower door 100, there is a risk that a patient could attach a ligature at various points. For example, there is a ligature risk at the meeting point of the door leaf 104 and the hinge jamb 108*a*, the meeting point of the door leaf 104 and the seal jamb 108*b* and at the hinges 106.

One way to reduce this risk is to employ a hinge such as that described in UK Patent No. 2516093, which reduces the ligature risk of the hinge whilst allowing two-way opening of the door. However, there still remains a ligature risk at the other end of the door leaf 104, adjacent the seal jamb 108*b*.

Figure 2:
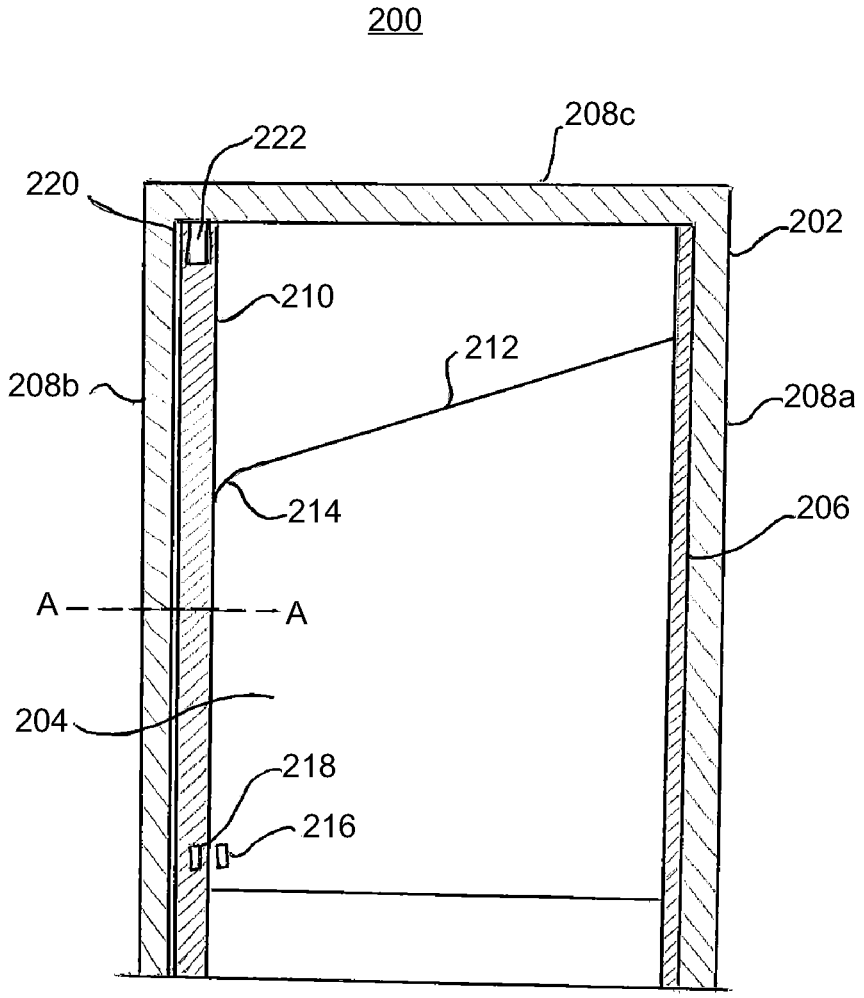
FIG. 2 shows a schematic view of a shower door according to a first embodiment of the disclosure.

FIG. 2 shows a shower door 200 according to a first embodiment of the present disclosure. The shower door 200 has a frame 202 similar to the frame 102 of the conventional shower door 100. The door frame 202 comprises a hinge jamb 208*a*, a seal jamb 208*b* and a header 208*c*. A door leaf 204 is joined to the hinge jamb 208*a* by a hinge 206. As discussed above, the hinge 206 may be a hinge such as that described in UK Patent No. 2516093, which reduces the ligature risk of the hinge whilst allowing two-way opening of the door 200.

In this embodiment, the shower door 200 comprises a sealing element 210 attached to the seal jamb 208*b* of the door frame 202. The sealing element 210 extends from the top to the bottom of the seal jamb 208*b*. When the door leaf 204 is in the closed position (i.e., the door leaf 204 is aligned with the seal jamb 208*b*), the sealing element 210 is in contact with the edge of the door leaf 204 such that a seal is provided between one side of the door 200 and the other. The seal 204 is flexible, such that is deformed by a force acting upon it. In this way, should a patient attempt to fix a ligature at the meeting point of the door leaf 204 and the seal jamb 208*b*, the seal 210 will deform and the ligature will come loose. The sealing 210 element is hollow in order to reduce its weight and increase its flexibility. The sealing element 210 may also be resilient such that, once it is deformed, it can revert to its original shape and form. This extends the lifespan of the sealing element 210, as it need not be replaced once deformed. The sealing element 210 may be formed of rubber, or any other material that provides the sealing ability, flexibility and/or resilience required.

In some embodiments, the door leaf 204 has a sloped top surface 212. The surface 212 slopes downwards from the hinge jamb 208*a* towards the seal jamb 208*b*. The slope may be between 10° and 20°, preferably 15°. The door leaf 204 also has a radiused corner 214 between its top surface 212 and the surface of the door leaf 204 adjacent the sealing element 210. In this way, if a patient attempts to fix a ligature anywhere along the top surface 212 of the door leaf 204, it will slide down the top surface 212, over the radiused corner 214 and between the door leaf 204 and the sealing element 210. The sealing element 210 will deform and the ligature will come loose. The top surface 212 may also be radiused along its length (i.e. along the edges of the surface on each side of the door leaf 204) such that no sharp edges are provided.

In some embodiments, the door leaf 204 and the sealing element 210 comprise respective magnets 216 and 218. The magnets 216 and 218 attract each other such that, as the door leaf 204 approaches the closed position, it is attracted to the sealing element 210 and is held in the closed position. The helps to maintain the seal provided by the sealing element 210 between one side of the door 200 and the other.

In some embodiments, a fixing strip 220 may be placed between the seal jamb 208*b* and the sealing element 210. The sealing element 210 is attached to the seal jamb 208*b* via the fixing strip 220 using fastening elements such as screws. Alternatively, other fixing means, such as adhesive, may be used to attach the sealing element 210 the fixing strip 220 and the fixing strip 220 to the seal jamb 208*b*. The fixing strip 220 ensures that a seal is maintained between the seal jamb 208*b* and the sealing element 210. The fixing strip 220 may be formed of rubber, or any other material that provides the sealing properties required.

In some embodiments, a stiffener 222 may be attached to the header jamb 208*c* for insertion into the sealing element 210. This may help to maintain the position of the sealing element 210 relative to the seal jamb 208*b* and the door leaf 204. The stiffener 222 may also aid the sealing element 210 in reverting to its original shape and form once deformed. Alternatively, the stiffener 222 may be fixed to the floor and inserted into the opposite end of the sealing element 210. The stiffener 222 may be formed of rubber, or any other material that provides the stiffening properties required.

Figure 3:
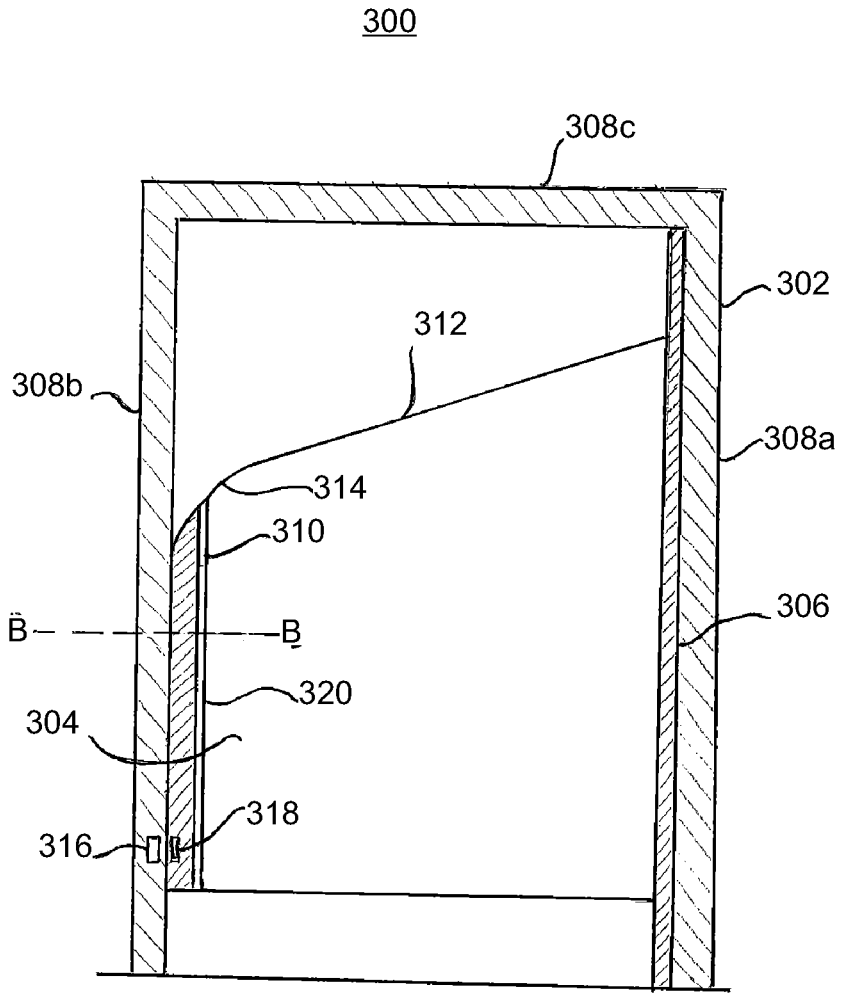
FIG. 3 shows a schematic view of a shower door according to a second embodiment of the disclosure.

FIG. 3 shows a shower door 300 according to a second embodiment of the present disclosure. The shower door 300 has a frame 302 similar to the frame 102 of the conventional shower door 100 and the frame 202 of the shower door 200 of the first embodiment. The door frame 302 comprises a hinge jamb 308*a*, a seal jamb 308*b* and a header 308*c*. A door leaf 304 is joined to the hinge jamb 308*a* by a hinge 306. The hinge 306 may be a hinge such as that described in UK Patent No. 2516093, which reduces the ligature risk of the hinge whilst allowing two-way opening of the door 300.

In this embodiment, the shower door 300 comprises a sealing element 310 attached to the edge of the door leaf 304 adjacent the seal jamb 308*b*. The sealing element 310 extends from the top to the bottom of the door leaf 304. When the door leaf 304 is in the closed position (i.e., the door leaf 304 is aligned with the seal jamb 308*b*), the sealing element 310 is in contact with the seal jamb 308*b* of the door frame 302 such that a seal is provided between one side of the door 300 and the other. Similarly to the first embodiment, the sealing element 310 is flexible, such that it is deformed by a force acting upon it. In this way, should a patient attempt to fix a ligature at the meeting point of the door leaf 304 and the seal jamb 308*b*, the sealing element 310 will deform and the ligature will come loose. The sealing element 310 is hollow in order to reduce its weight and increase its flexibility. The sealing element 310 is resilient such that, once it is deformed, it can revert to its original shape and form. This extends the lifespan of the sealing element 310 as it need not be replaced once deformed. The sealing element 310 may be formed of rubber, or any other material that provides the sealing ability, flexibility and/or resilience required.

Similarly to the first embodiment, the door leaf 304 has a sloped top surface 312. The surface 312 slopes downwards from the hinge jamb 308*a* towards the seal jamb 308*b*. The slope may be between 10° and 20°, preferably 15°. The door leaf 304 also has a radiused corner 314 between its top surface 312 and the surface of the door leaf 304 adjacent the sealing element 310. In this embodiment, the sealing element 310 is shaped so that its top end smoothly follows the curvature of the radiused corner 314. In this way, if a patient attempts to fix a ligature anywhere along the top surface of the door leaf 304, it will slide down the top surface 312, over the radiused corner 314 and between the sealing element 310 and the seal jamb 308*b*. The sealing element 310 will deform and the ligature will come loose. The top surface 312 may also be radiused along its length (i.e. along the edges of the surface on each side of the door leaf 304) such that no sharp edges are provided.

In some embodiments, the seal jamb 308*b* and the sealing element 310 comprise respective magnets 316 and 318. The magnets 316 and 318 attract each other such that, as the door leaf 304 approaches the closed position, it is attracted to the seal jamb 308*b* and is held in the closed position. This helps to maintain the seal provided by the sealing element 310 between one side of the door 300 and the other.

In some embodiments, a fixing strip 320 may be placed between the door leaf 304 and the sealing element 310. The sealing element 310 is attached to the door leaf 304, via the fixing strip 320, using fastening elements such as screws. Alternatively, other fixing means, such as adhesive, may be used to attach the sealing element 310 the fixing strip 320 and the fixing strip 320 to the door leaf 304. The fixing strip 320 ensures that a seal is maintained between the door leaf 304 and the sealing element 310. The fixing strip 320 may be formed of rubber, or any other material that provides the sealing properties required.

Figure 4A:
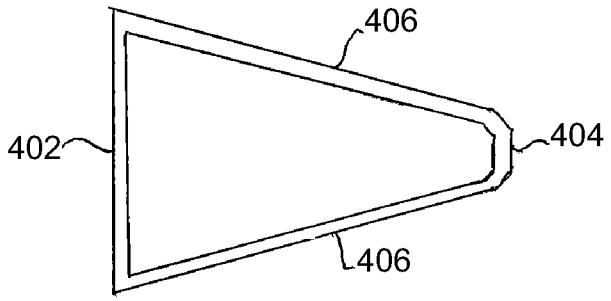
FIG. 4A shows a cross-sectional view of a first sealing element according to the disclosure.
Figure 4B:
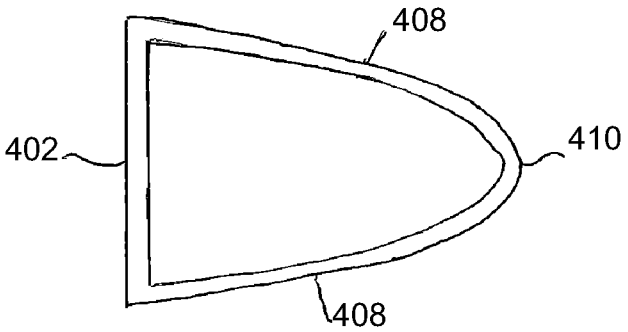
FIG. 4B shows a cross-sectional view of a second sealing element according to the disclosure.
Figure 4C:
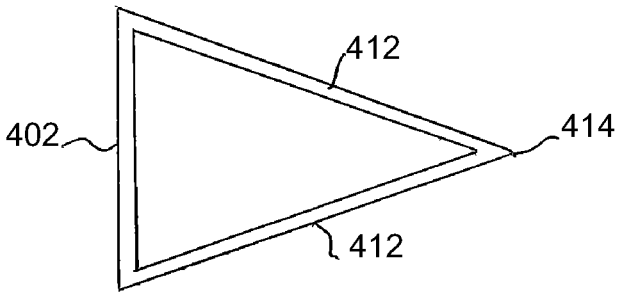
FIG. 4C shows a cross-sectional view of a third sealing element according to the disclosure.

FIGS. 4A to 4C show different possible configurations of the sealing elements 210 and 310. FIGS. 4A to 4C show cross-sections of the sealing elements 210 and 310 through lines A-A and B-B respectively. Each cross-section is in the orientation that corresponds to the first embodiment (FIG. 2), although it will be clearly understood by the skilled person that the orientation would be reversed to correspond to the second embodiment (FIG. 3). For simplicity, FIGS. 4A to 4C will be described in relation to the sealing element 210 of the first embodiment, although it will be clearly understood by the skilled person that the features would be equally applicable to the sealing element 310 of the second embodiment.

FIG. 4A shows a sealing element 210 with a generally trapezoidal cross-section. The sealing element has a first wall 402. The first wall 402 connects the sealing element 210 to the seal jamb 208*b*. This may be via a fixing strip 220. The sealing element has a second wall 404 parallel to the first wall 402. The first wall 402 and the second wall 404 are joined by straight walls 406 to provide a sealing element 210 with a hollow, generally trapezoidal cross-section. The edges of the second wall 404 may be chamfered. The second wall 404 contacts the door leaf 204 when the door leaf 204 is in the closed position. This provides a seal between opposite sides of the door 200.

FIG. 4B shows a sealing element 210 with a generally semi-elliptical cross-section. The sealing element has a first wall 402. As in FIG. 4A, the first wall 402 connects the sealing element 210 to the seal jamb 208*b*, in some embodiments via a fixing strip 220. The sealing element of FIG. 4B has curved walls 408 which meet at a point 410. This provides a sealing element 210 with a hollow, generally semi-elliptical cross-section. The point 410 contacts the door leaf 204 when the door leaf 204 is in the closed position. This provides a seal between opposite sides of the door 200.

FIG. 4C shows a sealing element 210 with a generally triangular cross-section. The sealing element has a first wall 402. As in FIGS. 4A and 4B, the first wall 402 connects the sealing element 210 to the seal jamb 208*b*, in some embodiments via a fixing strip 220. The sealing element of FIG. 4C has straight walls 412 which meet at a point 414. This provides a sealing element 210 with a hollow, generally triangular cross-section. The point 414 contacts the door leaf 204 when the door leaf 204 is in the closed position. This provides a seal between opposite sides of the door 200.

Each of the sealing elements shown in FIGS. 4A to 4C is hollow. This increases the flexibility of the sealing element 210 or 310, and therefore less weight is required for a ligature to deform the sealing element 210 or 310. This also allows a magnet 218 or 318 to be easily embedded within the hollow sealing element 210 or 310. A hollow sealing element 210 of the first embodiment may also have a stiffener 222 attached to the header jamb 208*c* inserted within. It will be appreciated that each sealing element 210 or 310 may alternatively be solid, whilst still being flexible and capable of having a magnet 218 or 318 embedded within.

Figure 5A:
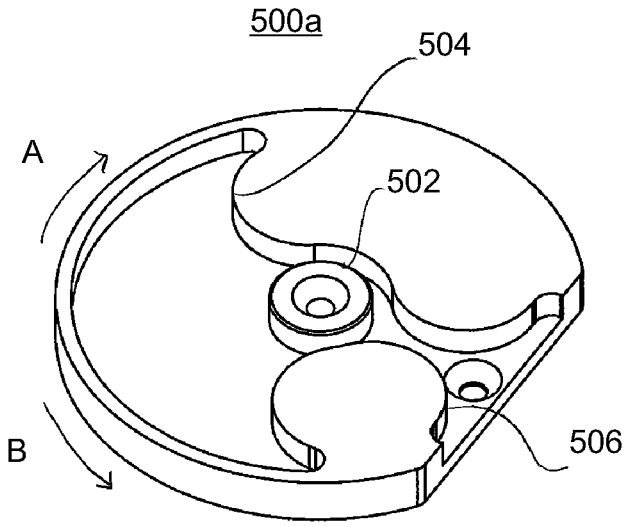
FIG. 5A shows an end cap for a hinge according to the disclosure.
Figure 5B:
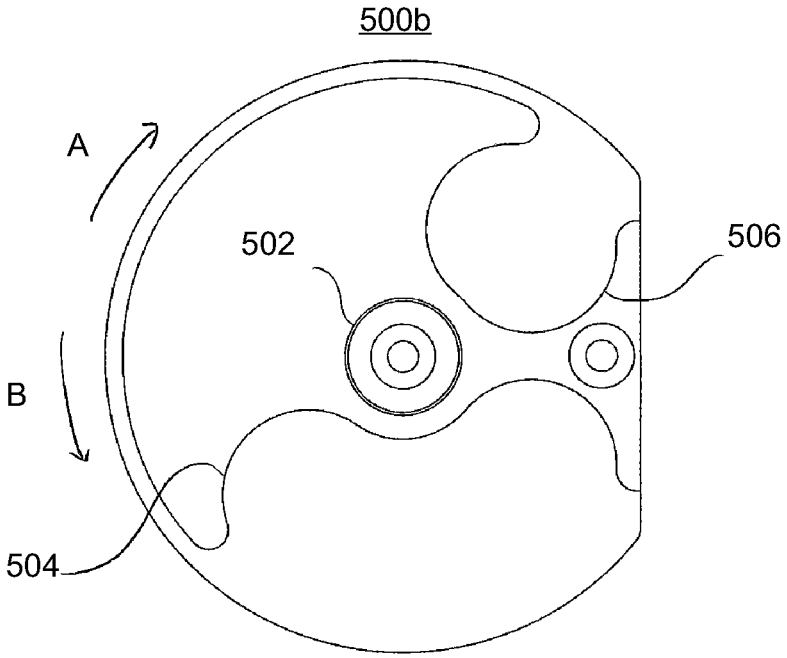
FIG. 5B shows schematic view of an end cap for a hinge according to the disclosure.

FIGS. 5A and 5B show an end cap for a hinge 206 or 306, such as that described in UK Patent No. 2516093. The end cap is configured to be embedded in the header jamb 208*c* or 308*c* of the door frame 202 or 302. The end cap is configured to limit the movement of the hinge 206 or 306 to only 90°. FIGS. 5A and 5B show the underside of the endcap.

FIG. 5A shows an end cap 500*a*, configured to prevent a hinge turning more than 90° between a closed position and an open position. The hinge cap 500*a* comprises a recess 502 for receiving the end of a hinge pin of the hinge 206 or 306. In operation, a door leaf rotates about an axis defined by the hinge pin. As discussed above, the hinge described in UK Patent No. 2516093 allows two-way opening of the door. The hinge cap 500*a* comprises a first stop 504 which is configured to prevent entirely the opening of a door in a first direction from a closed position (indicated by arrow A). The shape of the stop is configured to mate with the contour of the hinge. The hinge cap 500*a* also comprises a second stop 506 configured to limit the opening of the door in a second direction from the closed position (indicated by arrow B). In this case, the limit of movement is 90° from the closed position, although it will be appreciated that any suitable angle could be chosen by positioning the second stop 506 accordingly. Limiting movement of the door leaf prevents a ligature being trapped between the door leaf and the frame and prevents damage to the door if it is forced against the frame.

FIG. 5B shows a schematic view of an end cap 500*b*, also configured to prevent a hinge turning more than 90° between a closed and an open position. The end cap 500*b* is substantially similar to the end cap 500*a*, although the position of the stops 504 and 506 is reversed in order to limit movement in the opposite sense. In this case, the hinge cap 500*b* comprises a first stop 504 which is configured to prevent entirely the opening of a door in the second direction from a closed position (indicated by arrow B). The hinge cap 500*b* also comprises a second stop 506 configured to limit the opening of the door in the first direction from the closed position (indicated by arrow A). Again, the limit of movement is 90° from the closed position, although it will be appreciated that any suitable angle could be chosen by positioning the second stop 506 accordingly.

Figure 6:
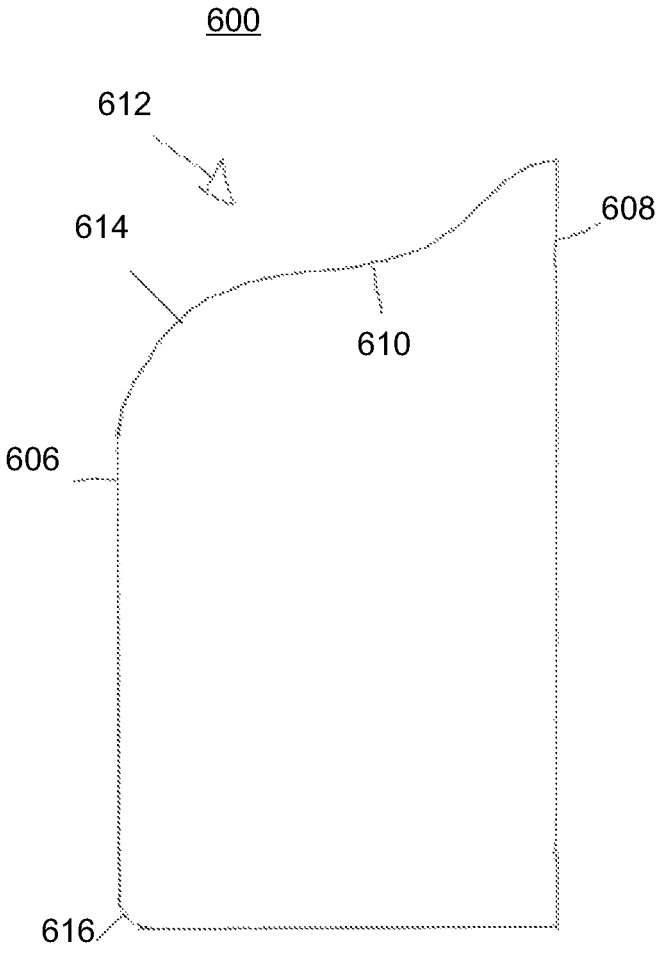
FIG. 6 shows a schematic view of a door leaf for use in the embodiment of FIG. 2 or in the embodiment of FIG. 3.

FIG. 6 shows a schematic view of an alternative door leaf 600 for use in the embodiment of FIG. 2 or in the embodiment of FIG. 3.

Sloped top surface 612 of the door leaf 600 has a continuously curved profile from a first edge 606 adjacent a sealing element (not shown) to a second edge 608 opposite the first edge and adjacent a door hinge (also not shown). At the first edge 606, the continuous curve forms a rounded/radiused corner 614, similar to the radiused corner 212 in FIG. 2 and the radiused corner 312 in FIG. 3. As in the embodiments of FIGS. 2 and 3, the radiused corner 614 encourages ligatures to slide off the sloped top surface 612, such that the possibility of a patient harming themselves is reduced. Additionally, the provision of a sloped top surface 612 having a continuously curved profile from the first edge 606 to the second edge 608 encourages ligatures to slide off the sloped top surface 612, thus further reducing the possibility of a patient harming themselves. Door leaf 600 also has a rounded/radiused bottom corner 616 at the first edge.

As shown, a central portion 610 of the sloped top surface 612 between the radiused corner 614 and the second edge 608 has a concave profile. The curvature of the sloped top surface 612 is exaggerated in FIG. 6 for illustrative purposes. As the skilled person will understand, it is possible to deviate from the specific proportions illustrated in FIG. 6 while still providing the desired effect of encouraging a ligature to slide off the sloped top surface 612. As with the embodiments of FIGS. 2 and 3, the sloped top surface 612 slopes down from the second edge 608 to the first edge 606.

The invention claimed is:

1. A shower door set comprising:

a door frame;

a door leaf;

a hinge to join the door leaf to the door frame; and a sealing element for providing a seal between the door frame and the door leaf, the sealing element comprising:

a flexible body attached to the door frame and configured to contact the door leaf when the door leaf is in a closed position;

wherein the flexible body is elongate and is hollow in a cross-section perpendicular to a longest dimension of the flexible body, the shower door set further comprising:

a stiffening element at one end of the flexible body, the stiffening element inserted into the flexible body and directly connected to one of a header jamb at the top of the door frame, and a floor.

2. The shower door set of claim 1, wherein the flexible body extends the length of the door frame.

3. The shower door set of claim 1 further comprising:

a first magnet inserted in the flexible body, the first magnet configured to interact with a second magnet in the door leaf;

wherein the first magnet and the second magnet are configured to attract the door leaf towards the closed position.

4. The shower door set of claim 1 further comprising a fixing element extending the length of the flexible body and to attach the flexible body to the door frame.

5. The shower door set of claim 1 wherein the flexible body is resilient such that the flexible body is configured to return to an original shape after deformation.

6. The shower door set of claim 1, where the hinge is configured to allow the door leaf to open in two directions from the closed position.

7. The shower door set of claim 1, wherein the door leaf comprises a top surface that slopes downward from a hinge side of the door leaf to a seal side of the door leaf distal the hinge side.

8. The shower door set of claim 1, wherein the door leaf comprises a rounded corner between a top surface of the door leaf and a surface of the door leaf on a seal side of the door leaf.

* * * * *